US008096251B2

(12) United States Patent
Suzuki

(10) Patent No.: US 8,096,251 B2
(45) Date of Patent: Jan. 17, 2012

(54) MULTI-HEAD SEWING MACHINE AND METHOD OF CONTROLLING OPERATION OF MULTI-HEAD SEWING MACHINE

(75) Inventor: Satoru Suzuki, Komaki (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 671 days.

(21) Appl. No.: 12/273,531

(22) Filed: Nov. 18, 2008

(65) Prior Publication Data

US 2009/0126610 A1 May 21, 2009

(30) Foreign Application Priority Data

Nov. 20, 2007 (JP) ..... 2007-300532

(51) Int. Cl.
*D05B 69/32* (2006.01)
*G06F 19/00* (2011.01)
*D05B 55/14* (2006.01)

(52) U.S. Cl. ..... 112/475.01; 112/155; 112/163; 112/277; 112/221

(58) Field of Classification Search ..... 112/270–277, 112/220, 221, 475.01, 475.17; 700/136–138
See application file for complete search history.

(56) References Cited

U.S. PATENT DOCUMENTS 3,749,037 A * 7/1973 Cash ..... 112/117
4,515,096 A * 5/1985 Ingram ..... 112/80.42
4,776,291 A * 10/1988 Tajima et al. ..... 112/98
5,287,819 A * 2/1994 Beatty et al. ..... 112/80.01
5,915,317 A * 6/1999 Thrash et al. ..... 112/470.13
7,578,249 B2 * 8/2009 Morgante et al. ..... 112/80.01

FOREIGN PATENT DOCUMENTS

JP 7-328269 A 12/1995

* cited by examiner

*Primary Examiner* — Ismael Izaguirre
(74) *Attorney, Agent, or Firm* — Rossi, Kimms & McDowell LLP

(57) ABSTRACT

A balancer is fixedly attached to a rotary input shaft of a crank mechanism that converts rotary drive of a needle bar drive source to up-and-down motion of a needle bar. The balancer is caused to rotate at substantially an opposite phase with respect to up-and-down motion of the needle bar with the rotary drive of the needle bar drive source. When the balancer is driven at substantially the opposite phase with respect to the up-and-down motion of the needle bar, inertia force in an up-and-down direction of the needle bar, generated due to the up-and-down motion of the needle bar is negated, whereby it is possible to reduce vibration generated in the up-and-down direction. Sewing heads paired with each other by being arbitrarily combined are controlled so as to be rotationally driven to cause rotational directions of the needle bar drive sources to become opposite directions to each other.

5 Claims, 4 Drawing Sheets

MULTI-HEAD SEWING MACHINE AND METHOD OF CONTROLLING OPERATION OF MULTI-HEAD SEWING MACHINE

BACKGROUND

The present invention relates to a multi-head sewing machine provided with a plurality of sewing heads and a method of controlling operation of the multi-head sewing machine. In particular, the present invention relates to a vibration reduction mechanism in a multi-head sewing machine for reducing vibration that may be generated with driving of a needle bar to a sewing machine body and a method of controlling operation of the multi-head sewing machine.

Heretofore, in a sewing machine provided with a needle bar that moves up and down in response to rotation of an upper shaft, a vibration reduction mechanism is known in which in order to reduce vibration generated in an up-and-down direction (vertical direction) of the needle bar with the up-and-down motion of the needle bar, a rotation type of eccentric weight that moves at substantially an opposite phase to that of the up-and-down motion of the needle bar is provided, and inertia force in the up-and-down direction of the needle bar is negated by causing this rotation type of eccentric weight to operate. In the vibration reduction mechanism conventionally known in the art, in order to simplify its configuration, the rotation type of eccentric weight rotates with an upper shaft by disposing the rotation type of eccentric weight on the axis of the upper shaft. However, in such a configuration, vibration generated in the up-and-down direction of the needle bar can be reduced, but vibration generated in a right-and-left direction (horizontal direction) perpendicular to the up-and-down direction (vertical direction) of the needle bar cannot be reduced.

Thus, as one example for solving the defect described above, for example, a vibration reduction apparatus for a sewing machine disclosed in Patent Document 1 below is proposed. In the vibration reduction apparatus disclosed in this Patent Document 1, another weight (balancer) other than the rotation type of eccentric weight is disposed on a predetermined axis provided separately from the upper shaft, a conversion mechanism for converting rotation of the upper shaft into an opposite direction thereof to transmit it to the balancer is provided, and the balancer disposed on the predetermined axis is caused to rotate in an opposite direction to a rotational direction of the upper shaft via the conversion mechanism. In such a configuration, since the rotational direction of the upper shaft for driving the needle bar (rotational direction of the rotation type of eccentric weight) and a rotational direction of the balancer become opposite, not only vibration generated in the up-and-down direction of the needle bar can be reduce, but also vibration generated in the right-and-left direction (horizontal direction) of the needle bar can be reduce.

[Patent Document 1] Japanese Patent Application Laid-open Publication No. 7-328269

Now, by applying a technique disclosed in the above Patent Document 1 to a multi-head sewing machine provided with a plurality of sewing heads, vibration to a sewing machine body generated with up-and-down motion of a needle bar can also be reduced. As described above, in the above-mentioned vibration reduction mechanism for causing the balancer to rotate in the opposite direction to rotation of the upper shaft, which causes the needle bar to move up and down, the conversion mechanism for converting the rotation of the upper shaft into the opposite direction thereof and transmitting it to the balancer is required. However, as is known in the prior art, in one of the plurality of sewing heads installed in the multi-head sewing machine, various mechanical elements (for example, a needle bar, a thread take-up lever, a press foot, a needle bar case and the like) have already been configured and disposed complicatedly for a sewing operation of the sewing machine. In the case where the vibration reduction mechanism including the conversion mechanism described above is further added to such a sewing head, not only the configuration of the sewing head becomes more complicated, but also harmful effects occur that the sewing head has to be made larger. In addition, costs of the multi-head sewing machine become increased, and thus, it is very inconvenient.

SUMMARY OF THE INVENTION

The present invention is made in view of the above-mentioned point, and it is an object of the present invention to provide a multi-head sewing machine provided with a vibration reduction mechanism and a method of controlling operation of the same, by which it is possible to reduce vibration in both up-and-down and right-and-left (horizontal) directions that may be generated in a plurality of sewing heads while a configuration of the sewing heads does not become more complicated, there is no need that each of the sewing heads is made larger, and further, costs of the multi-head sewing machine are not increased.

According to one aspect of the present invention, there is provided a multi-head sewing machine including: a plurality of sewing heads, each of the sewing heads having a needle bar caused to move up and down for carrying out a sewing operation, each of the plurality of sewing heads including: a needle bar drive source provided independently of each of the sewing heads; a crank mechanism for converting rotary drive of the needle bar drive source to up-and-down motion of the needle bar; and a balancer fixedly attached to a rotary input shaft of the crank mechanism, the balancer rotating at substantially an opposite phase with respect to the up-and-down motion of the needle bar in order to reduce vibration generated due to the up-and-down motion of the needle bar; and a control device for controlling each pair of sewing heads that are paired with each other by arbitrarily combining the plurality of sewing heads so that each pair of sewing heads is rotationally driven to cause rotational directions of the needle bar drive sources thereof to become opposite directions to each other.

According to the present invention, the balancer is fixedly attached to the rotary input shaft of the crank mechanism that converts rotary drive of the needle bar drive source into up-and-down motion of the needle bar, and this balancer is caused to rotate at substantially the opposite phase with respect to the up-and-down motion of the needle bar with the rotary drive of the needle bar drive source. By constructing it in this manner, the balancer driven at substantially the opposite phase with respect to the up-and-down motion of the needle bar allows inertia force in the up-and-down direction of the needle bar generated due to the up-and-down motion of the needle bar to be negated. Therefore, it is possible to reduce vibration generated in the up-and-down direction of the needle bar in each of the sewing heads. Further, by controlling each pair of sewing heads that are paired with each other by arbitrarily combining the plurality of sewing heads so that each pair of sewing heads is rotationally driven to cause rotational directions of the needle bar drive sources thereof to become opposite directions to each other, the balancers of each pair of sewing heads are caused to rotate reversely. This makes it possible to cancel inertia force in a horizontal direction of the needle bar generated due to rotation of the balancer for every pair of sewing heads without providing a drive mechanism for causing the balancer to rotate in an opposite direction separately from the needle bar drive source as a conventional case. In short, in the multi-head sewing machine body provided with the plurality of sewing heads, it is possible to reduce vibration generated in a horizontal direction of the needle bar easily.

Further, according to another aspect of the present invention, there is provided a method of controlling operation of a multi-head sewing machine, the multi-head sewing machine including a plurality of sewing heads, each of the plurality of sewing heads being constructed from: a needle bar caused to move up and down for carrying out a sewing operation; a needle bar drive source for driving the needle bar; a crank mechanism for converting rotary drive by the needle bar drive source into up-and-down motion of the needle bar; and a balancer fixedly attached to a rotary input shaft of the crank mechanism, the balancer rotating at substantially an opposite phase with respect to the up-and-down motion of the needle bar in order to reduce vibration generated due to the up-and-down motion of the needle bar, the method including: acquiring sewing data; specifying sewing heads of operating objects except for arbitrary sewing heads of resting objects of the plurality of sewing heads, the sewing heads of the resting objects are caused not to operate; and arbitrarily combining the specified sewing heads of operating objects so as to be paired with each other, and controlling the paired sewing heads thus combined so as to be rotationally driven to cause rotational directions of the needle bar drive sources of the paired sewing heads to become opposite directions to each other. Thus, only by controlling the sewing heads to be rotationally driven so that rotational directions of the needle bar drive sources in the paired sewing heads thus combined are opposite directions to each other, inertia force in the horizontal direction of the needle bar generated due to rotation of the balancer can be canceled easily for every pair of sewing heads.

The present invention can be configured and implemented not only as an apparatus invention but also as a method invention. In addition, the present invention can be implemented in the form of a program for a computer or a processor of a DSP and the like, and the present invention can also be implemented in the form of a memory medium in which such a program is stored.

According to the present invention, by driving the balancer provided in each of the sewing heads so as to become substantially an opposite phase with respect to the up-and-down motion of the needle bar, the inertia force in the up-and-down direction of the needle bar generated due to the up-and-down motion of the needle bar can be negated. In addition, by causing the balancers in each pair of sewing heads thus combined to rotate reversely to each other, the inertia force in the horizontal direction of the needle bar generated due to rotation of the balancer can be canceled for every pair of sewing heads. Therefore, since there is no need to provide a drive mechanism for causing the balancer to rotate in an opposite direction separately from the needle bar drive source as a conventional case, the present invention can achieve a distinguished effect that vibration that may be generated in a sewing machine body can be reduced as small as possible easily without making the sewing head to be complicated and enlarged, and without increasing costs of the multi-head sewing machine.

DETAILED DESCRIPTION OF THE INVENTION

Hereinafter, an embodiment of this invention will be described in detail with reference to the accompanying drawings.

Figure 1:
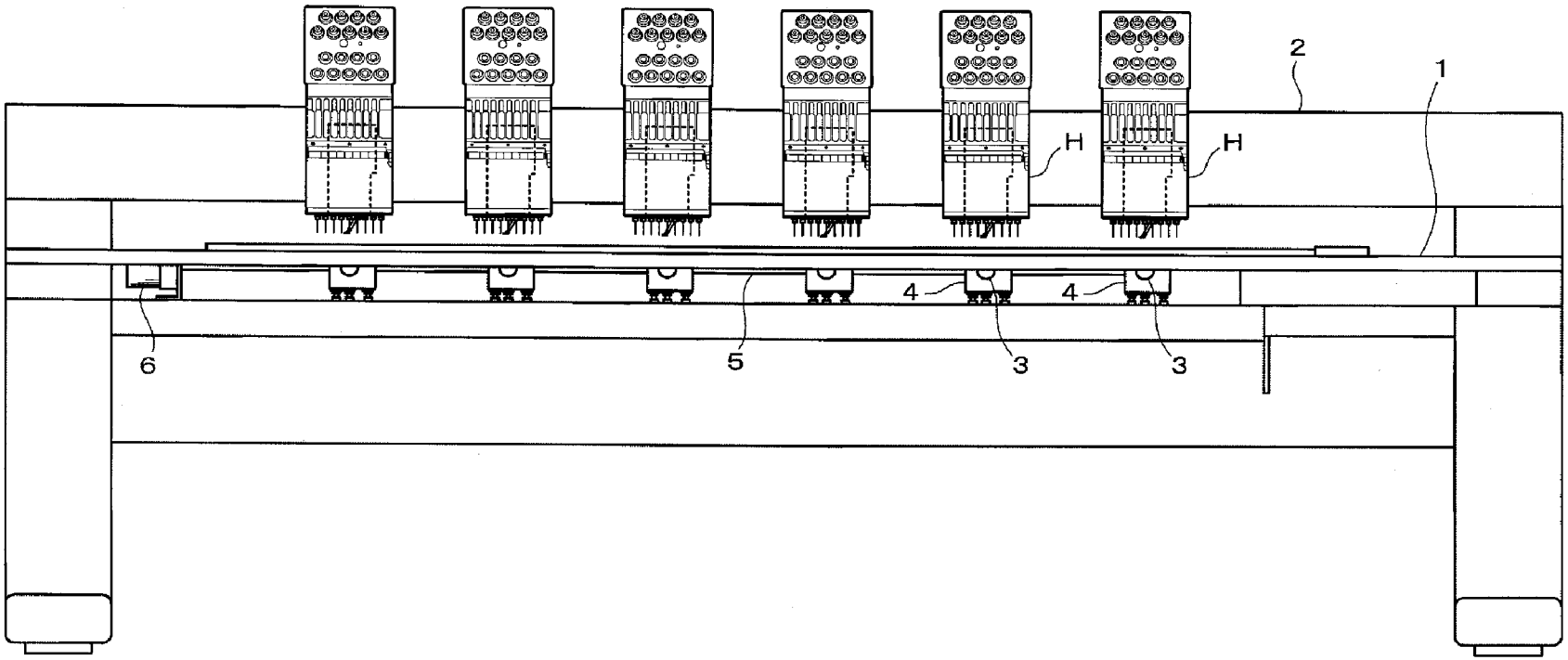
FIG. 1 is a front view showing one embodiment of a multi-head sewing machine according to the present invention.

FIG. 1 is a front view showing one embodiment of a multi-head sewing machine according to the present invention. In a multi-head sewing machine shown in FIG. 1, a reference numeral 1 denotes a long sewing machine table extending in a horizontal direction (right-and-left direction), and a reference numeral 2 denotes an upper frame of the sewing machine, which is disposed above the sewing machine table 1. On the upper frame 2 of the sewing machine, a plurality (six in the example shown in FIG. 1) of sewing heads H are arranged at even intervals along a longitudinal direction (right-and-left direction) of the upper frame 2. A hook base 4 for supporting a rotary hook 3 is provided below each of the sewing heads H at substantially the same height as that of the sewing machine table 1 so as to correspond to each sewing head H. One common drive shaft 5 is provided so as to pass through the respective hook bases 4 in the right-and-left direction, and one drive motor 6 for driving the hooks (a common motor for the plurality of rotary hooks 3) is connected to one end of this drive shaft 5. Therefore, when this drive motor 6 is driven, the drive shaft 5 is rotationally driven. While the drive shaft 5 is rotationally driven, all of the individual rotary hooks 3 provided so as to correspond to the respective sewing heads H rotate simultaneously.

Figure 2:
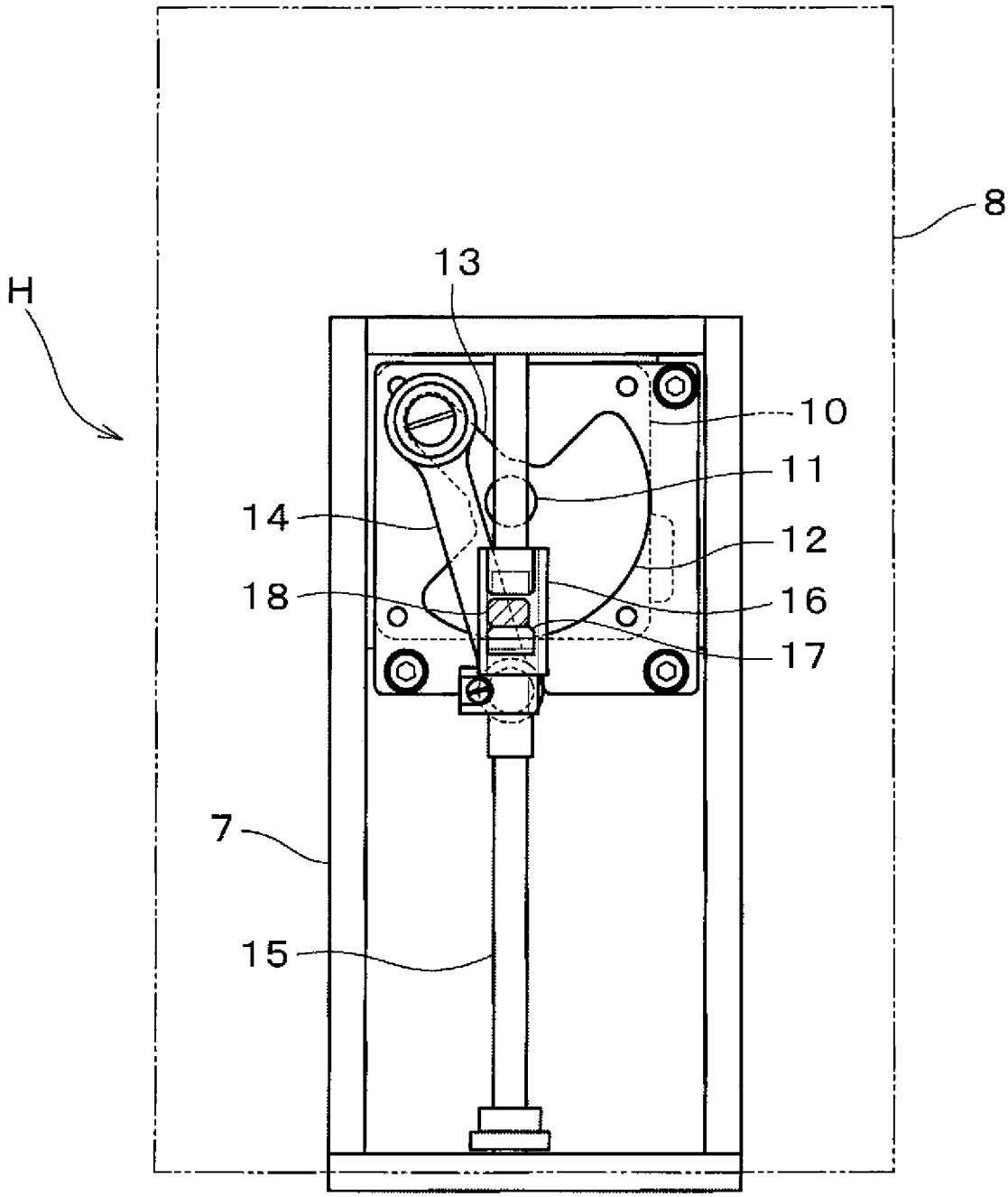
FIG. 2 is a schematic front view of an arm of one sewing head from which a needle bar case provided at the front of the sewing head is removed.
Figure 3:
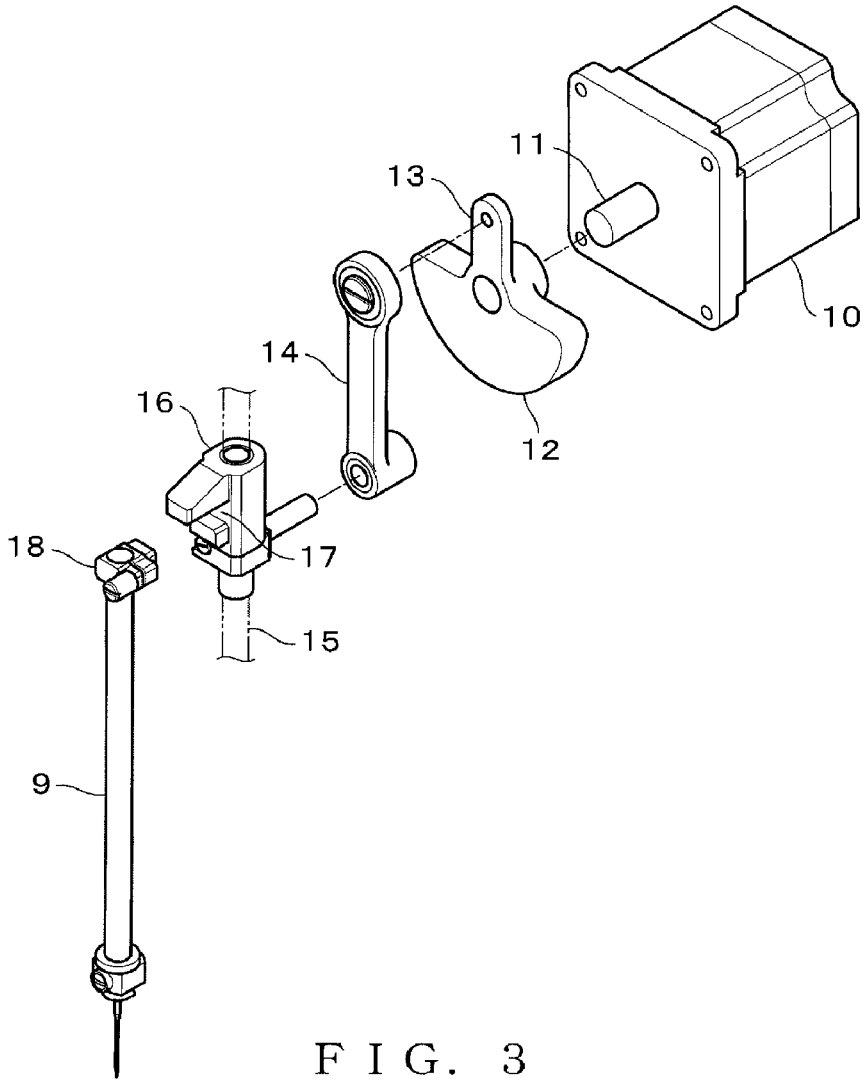
FIG. 3 is an exploded perspective view of a needle bar drive mechanism.

FIG. 2 shows a schematic front view of an arm 7 of one sewing head H from which a needle bar case 8 provided at the front of the sewing head is removed, and FIG. 3 shows an exploded perspective view of a needle bar drive mechanism in one sewing head H. As is known in the prior art, the sewing head H is constructed from an arm 7 fixed to the upper frame 2, and a needle bar case 8 slidably supported to a front surface of the arm 7 in the right-and-left direction (lateral direction). The arm 7 is a support member for mounting and supporting various mechanical elements (for example, a needle bar, a thread take-up lever, a press foot, a needle bar case and the like) for a sewing operation of the sewing machine, which constitute the sewing head H.

A plurality of needle bars 9 (for example, nine needle bars are provided in FIG. 1) are provided in the needle bar case 8 so as to be capable of up-and-down motion, and a needle bar drive motor 10 to cause only needle bars 9 selected from the plurality of needle bars 9, which are provided in the needle bar case 8, to move in the up-and-down direction is provided in the arm 7. As shown in FIGS. 2 and 3, a drive lever 13 integrally having a balancer 12 with a predetermined shape and weight is fixed to a motor shaft 11 of the needle bar drive motor 10. Namely, the drive lever 13 is combined with the balancer 12. In order to negate inertia force generated with up-and-down motion of the needle bar 9, the drive lever 13 combined with the balancer 12 is formed in an eccentric manner and with eccentric weight in which weight is distributed so that the center of gravity thereof is positioned at an eccentric position from the shaft center of the motor shaft 11. Further, by considering and adjusting current relative positions among the drive lever 13, a connecting arm 14, a needle bar drive member 16 and the like, the drive lever 13 combined with the balancer 12 is disposed (fixed) on the motor shaft 11 so that the balancer 12 rotates so as to face from an upper position to a lower position and from the lower position to the upper position at substantially an opposite phase with respect to the up-and-down motion of the needle bar 9 in accordance with the rotary drive of the needle bar drive motor 10.

One end of the connecting arm 14 is pivotably mounted on a tip portion of the drive lever 13, and the other end of the connecting arm 14 at the other side is pivotably mounted on the needle bar drive member 16 up-and-down movably provided on the base needle bar 15. Further, an engaging concave portion 17 capable of engaging with a needle bar clamp 18 provided on the needle bar 9 is formed on the needle bar drive member 16.

According to the configuration described above, by driving the needle bar drive motor 10, it is possible to drive the needle bar 9 up and down in a reciprocatory manner. Namely, when drive of the needle bar drive motor 10 causes the drive lever 13 to rotate, rotation of the drive lever 13 is converted into power to cause the needle bar drive member 16 to reciprocate up and down by means of the connecting arm 14 (that is, a crank mechanism is configured by the drive lever 13 and the connecting arm 14), and the needle bar drive member 16 moves up and down along the base needle bar 15. In this case, only needle bar or needle bars 9, for which the needle bar clamp 18 engages with the engaging concave portion 17 of the needle bar drive member 16, of the plurality of needle bars 9 included in the needle bar case 8 is driven up and down in a reciprocatory manner with the up-and-down motion of the needle bar drive member 16 by sliding the needle bar case 8.

At this time, with the rotary drive of the needle bar drive motor 10 that causes the needle bar 9 to move up and down, the balancer 12 rotates so as to face from the upper position to the lower position and from the lower position to the upper position at substantially the opposite phase with respect to the up-and-down motion of the needle bar 9 in accordance with the up-and-down motion of the needle bar 9. Namely, the balancer 12 rotates so as to face from the lower position to the upper position when the needle bar 9 moves from the top to the bottom. On the other hand, the balancer 12 rotates so as to face from the upper position to the lower position when the needle bar 9 moves from the bottom to the top. Thus, since it is possible to reduce inertia force (excitation force) generated with reciprocation of the needle bar 9, vibration caused by the inertia force generated due to the up-and-down motion of the needle bar 9 is negated. In this regard, the drive lever 13 and the balancer 12 are not limited to be integrally formed, and they may be formed separately and fixed to the motor shaft 11 by combining them.

As described above, in the multi-head sewing machine according to the present invention, by causing the balancer 12 to rotate at substantially the opposite phase with respect to the up-and-down motion of the needle bar 9, vibration generated due to the up-and-down motion of the needle bar 9, that is, vibration in the up-and-down direction of the needle bar 9 is negated in each of the sewing heads H. However, it is apparent that this cannot reduce vibration generated by causing the balancers 12 to rotate in the respective sewing heads H, that is, vibration in a horizontal direction perpendicular to the up-and-down direction of the needle bar 9. Therefore, in the present invention, by rotationally controlling a rotational direction of the needle bar drive motor 10 in each of the sewing heads H so that the rotational directions of adjacent sewing heads H that are set to be paired become opposite directions to each other, the vibration of the horizontal direction generated with rotation of the balancers 12 can be negated. Such operation control of the sewing heads H will be described with reference to FIGS. 4 to 6. Here, since the motor shaft 11 faces to a Y direction (cross (front-and-back) direction) in the present embodiment, vibration generated in a horizontal direction is one in the right-and-left direction.

Figure 4:
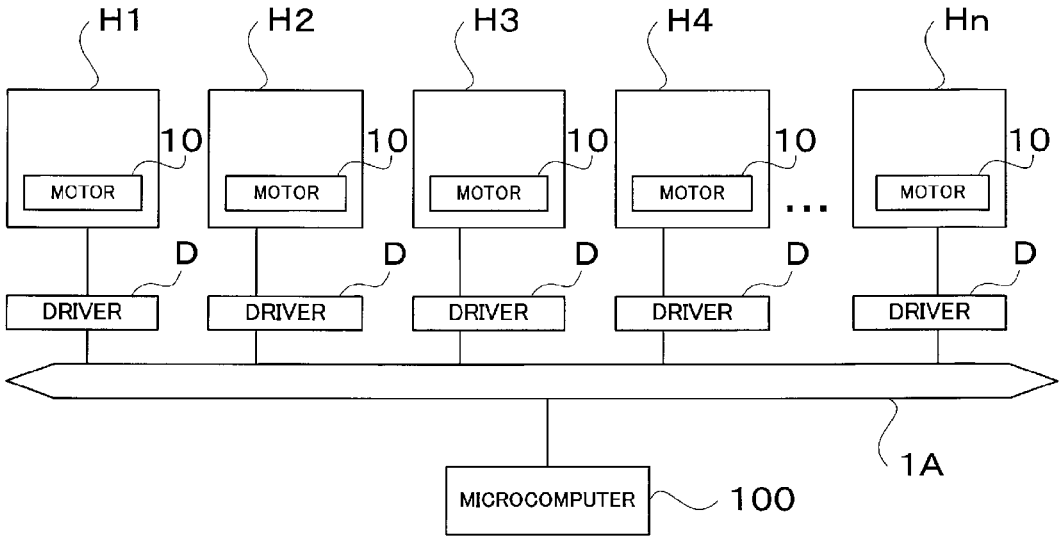
FIG. 4 is a system schematic view showing one embodiment of the system that carries out operation control for the sewing heads in the multi-head sewing machine.

FIG. 4 is a system schematic view showing one embodiment of the system that carries out operation control for each of the plurality of sewing heads in the multi-head sewing machine. As is known in the prior art, various kinds of motions in each of the sewing heads H1 to Hn of the multi-head sewing machine are controlled by a microcomputer (control device) 100 constructed so as to include a CPU (Central Processing Unit), a ROM, a RAM and the like (not shown in the drawings). A driver and controller D for driving and controlling the respective mechanisms in each of the plurality of sewing heads H1 to Hn (hereinafter, referred to as "head separated driver") is connected to this microcomputer 100 for every sewing head H1 to Hn via a predetermined communication interface (communication bus and the like) 1A. In accordance with a control command from the microcomputer (control device) 100, one head separated driver D individually controls the needle bar drive motor 10 included in corresponding one of the sewing heads H1 to Hn and the motor for individually driving other various mechanical elements for a sewing operation of the sewing machine (for example, a thread take-up lever, a press foot, a needle bar case and the like) included in each of the sewing heads H1 to Hn, whereby a sewing operation in the sewing head is carried out.

Figure 5:
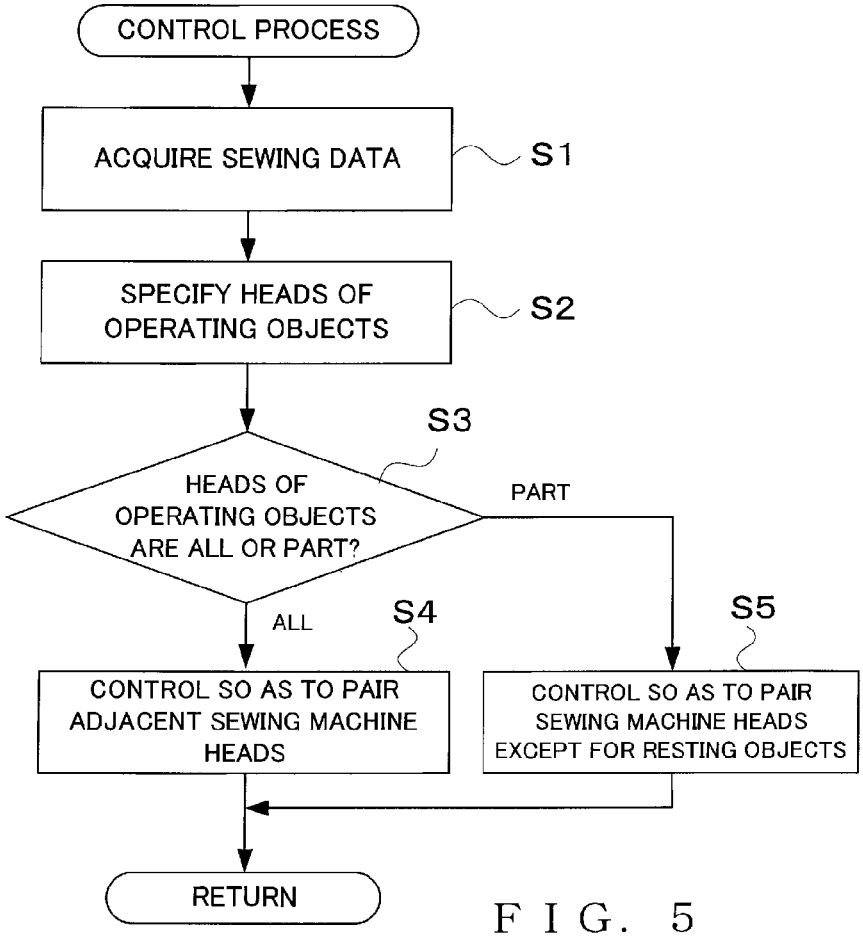
FIG. 5 is a flowchart showing one embodiment of a control process carried out by a microcomputer (control device)

FIG. 5 is a flowchart showing one embodiment of a control process carried out by the microcomputer (control device) 100 shown in FIG. 4. At Step S1, known sewing data, which is used to control the multi-head sewing machine, are acquired. At Step S2, sewing heads to be operating objects (or, which may be sewing heads to be resting objects) are specified from the plurality of sewing heads H1 to Hn constituting the multi-head sewing machine. At Step S3, it is determined whether the specified sewing heads of operating objects are all of the sewing heads H1 to Hn constituting the multi-head sewing machine or partial sewing heads of the plurality of sewing heads H1 to Hn constituting the multi-head sewing machine. In the case where the sewing heads of the operating objects are all of the sewing heads H1 to Hn included in the multi-head sewing machine ("all" at Step S3), all of the sewing heads H1 to Hn are set so that adjacent sewing heads are combined to be paired, and drive control based on the sewing data is carried out for all pairs of sewing heads set so as to be paired (Step S4). In accordance with this operation, each head separated driver D carries out a sewing operation based on the sewing data.

On the other hand, in the case where it is determined that the sewing heads of the operating objects are a part of the sewing heads ("part" at Step S3), the part of the sewing heads (that is, the sewing heads of the operating objects) except for the sewing heads of resting objects are set so as to be combined and paired with each other, and drive control based on the sewing data is carried out for only the pairs of sewing heads set to be paired (Step S5). Of course, in this case, the drive control is carried out for the sewing heads of the resting objects. In accordance with this operation, the head separated driver D in each of the sewing heads of the operating objects carries out a sewing operation based on the sewing data. Namely, the multi-head sewing machine may often be used in a manner that only partial sewing heads H of a plurality of sewing heads H are caused to operate and operation of the remaining sewing heads is suspended. In the case where such usage is carried out, a combination setting in which only the sewing heads H of the operating objects are paired except for the sewing heads H of the resting objects is carried out so that inertia force in a right-and-left direction is negated in the operating sewing heads H, and drive control is carried out for pairs of sewing heads H, which are set so as to be paired, so that rotational directions of the needle bar drive motors 10 in each pair of the sewing heads H become opposite directions to each other, whereby a sewing operation based on sewing data is carried out.

Figure 6:
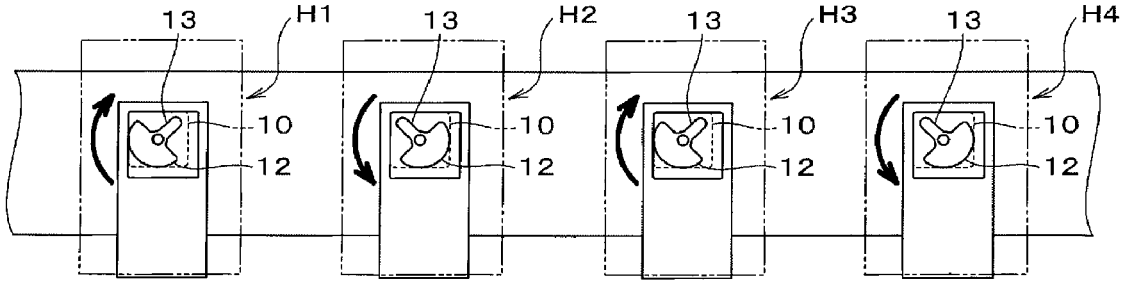
FIG. 6 is a schematic view showing a state of motion of a drive lever carried out under control by the control device.

Here, FIG. 6 is a schematic view showing a state of motion of the drive lever 13 in each sewing head caused to be the operating object, which is carried out under control of the microcomputer (control device) 100 described above. In FIG. 6, a rotational direction of the needle bar drive motor 10 of each of the sewing heads H1 to H4 is shown with an arrow. Namely, in the present embodiment, an example of the case where a sewing operation is carried out as follows is shown. Each of four sewing heads H1 to H4 is set to an operating object, and the sewing heads H1, H2 and the sewing heads H3, H4 are set so as to be paired by being combined. In such a case, as shown in FIG. 6, the needle bar drive motor 10 is caused to rotate in a clockwise direction (right rotation) in each of odd-numbered sewing heads H1, H3 from the left side of FIG. 6, and the needle bar drive motor 10 is caused to rotate in a counterclockwise direction (left rotation) in each of even-numbered sewing heads H2, H4 from the left side of FIG. 6. The sewing operation is carried out while the needle bar drive motors 10 of the respective sewing heads H1 to H4 are rotationally driven individually.

In accordance with execution of the control process (program) by the microcomputer (control device) 100, the head separated driver D (see FIG. 4) rotationally drives the needle bar drive motor 10 provided in each of the sewing heads H1 to H4. At this time, when the sewing heads H1 to H4 are focused point by point, vibration to a right-and-left direction is generated due to rotation of the balancer 12 in each of the sewing heads H1 to H4. However, when the adjacent sewing heads H1, H2 and the adjacent sewing heads H3, H4 are focused as two pairs of sewing heads that are respectively paired, in each pair, the balancers 12 of the sewing heads H1 and H2 (H3 and H4) rotate so that a rotational direction of the balancer 12 of one sewing head H1 (H3) and a rotational direction of the balancer 12 of the other sewing head H2 (H4) that are paired with the one sewing head H1 (H3) become opposite directions. Thus, in each of the one pair of sewing heads H1, H2 and the other pair of sewing heads H3, H4, inertia force in a right-and-left direction which is generated due to rotation of the balancers 12 is always generated to a direction in which the inertia force is to be negated with each other. If the inertia force is negated, vibration in a right-and-left direction caused by the inertia force is also canceled. Namely, in each of the one pair of sewing heads H1, H2 and the other pair of sewing heads H3, H4, vibration in the right-and-left direction is canceled so as not to be generated (the microcomputer (control device) 100 rotationally drives the needle bar drive motors 10 in such a manner).

In the multi-head sewing machine described above, a vibration reduction mechanism whose configuration is different from conventional one has been configured so as to be capable of easily controlling the rotational direction of the balancer 12 by fixing the balancer 12 having a predetermined shape to the motor shaft 11. According to the vibration reduction mechanism having such a configuration, not only suppression of the vibration in the up-and-down direction which may be generated in each sewing head H but also suppression of the vibration in the right-and-left direction can be achieved easily without affecting anything on other various mechanical elements (for example, a thread take-up lever, a press foot, a needle bar case and the like) for a sewing operation of the sewing machine, which are included in each sewing head H. Namely, the needle bar drive motor 10 also operates as a drive source for moving the needle bar 9 up and down. However, in the case where the needle bar 9 is caused to move up and down, a rotational direction of the needle bar drive motor 10 is not particular limited. Therefore, in order to reduce the vibration in the right-and-left direction, rotational directions of the needle bar drive motors 10 in the adjacent sewing heads H may merely be controlled in opposite directions to rotate the balancers 12 so as to become opposite directions to each other. Such control can be easily achieved by executing the control process (program) described above by means of the microcomputer (control device) 100.

As described above, the multi-head sewing machine according to this invention is controlled so that vibration due to the up-and-down motion of the needle bar 9 is canceled by means of the balancer 12, and the rotational directions of the needle bar drive motors 10 (and the balancers 12 connected thereto) in the adjacent sewing heads H become opposite directions to each other. Vibration due to rotary drive of the balancer 12 can thereby be canceled. According to such a configuration, there is especially no need to provide a dedicated balancer for canceling vibration of a horizontal direction and a special mechanism for reversely rotating this balancer. For that reason, there is nothing that a configuration of the sewing heads H becomes complicated by increasing the number of components thereof and there is no need to enlarge the sewing head H. Moreover, there is nothing that costs of the sewing heads H are increased, and therefore, there is nothing that costs of the multi-head sewing machine are increased with this. Thus, since the present invention allows vibration that may be generated in a sewing machine body to be reduced by a simple configuration and control, it is very advantageous compared with the prior art.

In this regard, an example in which two adjacent sewing heads H are combined in the case where setting of pairs of sewing heads H is carried out so that the sewing heads H are combined and paired has been shown in the embodiment described above, but a combination method is not limited to adjacent ones. Namely, when the sewing heads H are combined, a pair of sewing heads may be formed by appropriately combining sewing heads H to be operating objects that are not adjacent ones. For example, sewing heads H arranged at alternate ones may be combined. Alternatively, by combining some sewing heads H to integrate a group unit, the plurality of sewing heads H may be integrally combined. Thus, in the case where setting of the paired sewing heads H is carried out, any combination method may be used for the setting.

In this regard, in the case where the present invention is applied to the multi-head sewing machine provided with odd-numbered sewing heads H, inertia force in the horizontal direction in one of the plurality of sewing heads H cannot be canceled and negated. However, even so, since inertia force in the horizontal direction in the other sewing heads H is canceled and negated for every pair, vibration in the horizontal direction as the whole sewing machine is reduced to a large extent. Therefore, the present invention is very effective. In particular, the more the number of sewing heads H is (for example, 20 heads or more), the larger the canceled inertia force in the horizontal direction is. For that reason, it goes without saying that, even though inertia force in a horizontal direction in only one sewing head H cannot be canceled, vibration generated due to it does not have a great impact and never becomes a problem in particular.

In this regard, an example of the multi-head sewing machine having a large number of sewing heads H in each of which the motor shaft 11 of the needle bar drive motor 10 is disposed so as to be oriented to a front-and-back direction of the sewing machine has been shown in the embodiment described above, but the multi-head sewing machine is not limited thereto. The present invention can be applied to even a multi-head sewing machine having a large number of sewing heads H in each of which a motor shaft 11 is disposed so as to be oriented to a right-and-left direction (lateral direction) of the sewing machine. To briefly explain it, even in the case of the multi-head sewing machine in which the motor shaft 11 is disposed so as to be oriented to a right-and-left direction of the sewing machine, by fixing a balancer 12 with a predetermined shape to the motor shaft 11 to cause the balancer 12 to rotate as a vibration reduction mechanism similar to that in the case of the multi-head sewing machine described above in which the motor shaft 11 is disposed so as to be oriented to a front-and-back direction of the sewing machine, vibration generated due to up-and-down motion of a needle bar 9, that is, vibration in an up-and-down direction of the needle bar 9 can be negated. Further, vibration in a cross direction is to be generated in each sewing head H. However, since the vibration is canceled by the paired sewing heads H, the vibration in the cross direction can also be suppressed. Therefore, even in the multi-head sewing machine having a large number of sewing heads H in each of which the motor shaft 11 is disposed so as to be oriented to the right-and-left direction of the sewing machine, it is very effective to apply the present invention thereto.

The present disclosure relates to subject matter contained in Japanese Patent Application No. 2007-300532, filed on Nov. 20, 2007, the disclosure of which is expressly incorporated herein by reference in its entirety.

What is claimed is:

1. A multi-head sewing machine comprising:

a plurality of sewing heads, each of the sewing heads having a needle bar caused to move up and down for carrying out a sewing operation, each of the plurality of sewing heads including:

a needle bar drive source provided independently of each of the sewing heads;

a crank mechanism for converting rotary drive of the needle bar drive source to up-and-down motion of the needle bar; and a balancer fixedly attached to a rotary input shaft of the crank mechanism, the balancer rotating at substantially an opposite phase with respect to the up-and-down motion of the needle bar in order to reduce vibration generated due to the up-and-down motion of the needle bar; and a control device for controlling each pair sewing heads that are paired with each other by arbitrarily combining the plurality of sewing heads so that each pair of sewing heads is rotationally driven to cause rotational directions of the needle bar drive sources thereof to become opposite directions to each other.

2. The multi-head sewing machine as claimed in claim 1, wherein the paired sewing heads are obtained by combining every two sewing heads arranged adjacently.

3. The multi-head sewing machine as claimed in claim 1, wherein the paired sewing heads are obtained by combining only sewing heads of operating objects except for arbitrary sewing heads of resting objects from the plurality of sewing heads, and the sewing heads of resting objects are caused not to operate.

4. A method of controlling operation of a multi-head sewing machine, the multi-head sewing machine comprising a plurality of sewing heads, each of the plurality of sewing heads being constructed from: a needle bar caused to move up and down for carrying out a sewing operation; a needle bar drive source for driving the needle bar; a crank mechanism for converting rotary drive by the needle bar drive source into up-and-down motion of the needle bar; and a balancer fixedly attached to a rotary input shaft of the crank mechanism, the balancer rotating at substantially an opposite phase with respect to the up-and-down motion of the needle bar in order to reduce vibration generated due to the up-and-down motion of the needle bar, the method comprising:

acquiring sewing data;

specifying sewing heads of operating objects except for arbitrary sewing heads of resting objects of the plurality of sewing heads, the sewing heads of the resting objects are caused not to operate; and arbitrarily combining the specified sewing heads of operating objects so as to be paired with each other, and controlling the paired sewing heads thus combined so as to be rotationally driven to cause rotational directions of the needle bar drive sources of the paired sewing heads to become opposite directions to each other.

5. A computer readable memory medium for storing a program to cause a computer to execute an operation control method of a multi-head sewing machine, the multi-head sewing machine comprising a plurality of sewing heads, each of the plurality of sewing heads being constructed from: a needle bar caused to move up and down for carrying out a sewing operation; a needle bar drive source for driving the needle bar; a crank mechanism for converting rotary drive by the needle bar drive source to up-and-down motion of the needle bar; and a balancer fixedly attached to a rotary input shaft of the crank mechanism, the balancer rotating at substantially an opposite phase with respect to the up-and-down motion of the needle bar in order to reduce vibration generated due to the up-and-down motion of the needle bar, the program causing the computer to execute:

a procedure to acquire sewing data;

a procedure to specify sewing heads of operating objects of the plurality of sewing heads, arbitrary sewing heads of resting objects being removed from the plurality of sewing heads, the sewing heads of resting objects being caused not to operate; and a procedure to arbitrarily combine the specified sewing heads of operating objects so as to be paired with each other, and to control the paired sewing heads thus combined so as to be rotationally driven to cause rotational directions of the needle bar drive sources of the paired sewing heads to become opposite directions to each other.

* * * * *